US008208842B2

(12) United States Patent
Hashimoto

(10) Patent No.: US 8,208,842 B2
(45) Date of Patent: Jun. 26, 2012

(54) BELT DRIVING CONTROL DEVICE, BELT DEVICE, IMAGE FORMING APPARATUS, BELT DRIVING CONTROL METHOD, COMPUTER PROGRAM, AND RECORDING MEDIUM

(75) Inventor: Takeaki Hashimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 422 days.

(21) Appl. No.: 12/540,625

(22) Filed: Aug. 13, 2009

(65) Prior Publication Data

US 2010/0054768 A1 Mar. 4, 2010

(30) Foreign Application Priority Data

Aug. 29, 2008 (JP) ..... 2008-221621

(51) Int. Cl.
*G03G 15/01* (2006.01)
*G03G 15/00* (2006.01)

(52) U.S. Cl. ..... 399/302; 399/162; 399/303

(58) Field of Classification Search ..... 399/38, 399/66, 162, 302, 303, 308, 313, 167, 329
See application file for complete search history.

(56) References Cited

U.S. PATENT DOCUMENTS

| | | | | |
|---|---|---|---|---|
| 7,050,731 | B2 * | 5/2006 | Bannai et al. | 399/49 |
| 7,058,327 | B2 * | 6/2006 | Isobe | 399/66 |
| 7,197,256 | B2 * | 3/2007 | Nishizaki | 399/66 |
| 7,251,444 | B2 * | 7/2007 | Matsuda et al. | 399/301 |
| 7,386,262 | B2 * | 6/2008 | Okamura et al. | 399/298 |
| 7,499,667 | B2 * | 3/2009 | Matsuda | 399/302 |
| 7,929,894 | B2 * | 4/2011 | Murata et al. | 399/302 |
| 2009/0190972 | A1 * | 7/2009 | Ohkubo et al. | 399/301 |

FOREIGN PATENT DOCUMENTS

| | | |
|---|---|---|
| JP | 2754582 | 3/1998 |
| JP | 2002-72816 | 3/2002 |
| JP | 2004-21236 | 1/2004 |
| JP | 2005-115398 | 4/2005 |
| JP | 2006-23403 | 1/2006 |
| JP | 2006-106642 | 4/2006 |

* cited by examiner

*Primary Examiner* — Robert Beatty
(74) *Attorney, Agent, or Firm* — Oblon, Spivak, McClelland, Maier & Neustadt, L.L.P.

(57) ABSTRACT

A belt driving control device includes an endless belt looped over a plurality of supporting rollers, a driving source supplying rotational driving force the supporting rollers, a detecting section detecting a periodical thickness deviation of the endless belt in a circumferential direction of the endless belt and carrying out data sampling for detection of the thickness deviation simultaneously with rotation of the endless belt, a memory storing data on the thickness deviation obtained based on the data sampling, and a control section controlling drive of the driving source such that the detected thickness deviation of the endless belt is canceled out based on the data on the thickness deviation stored in the memory, and such that the endless belt is driven to travel one rotation upon detecting a predetermined condition to carry out the data sampling for one rotation and update the stored data with new data.

13 Claims, 8 Drawing Sheets

BELT DRIVING CONTROL DEVICE, BELT DEVICE, IMAGE FORMING APPARATUS, BELT DRIVING CONTROL METHOD, COMPUTER PROGRAM, AND RECORDING MEDIUM

BACKGROUND OF THE INVENTION

1. Field of the Invention

The present invention generally relates to a belt driving control device configured to control a belt looped over a plurality of supporting rollers, a belt device having the belt driving control device, an image forming apparatus having the belt device such as a digital multifunction apparatus that includes a combination of functions such as a copying apparatus, a printer, facsimile, or a belt device, a method for controlling the drive of a belt conveyed in the belt driving control device, the belt device, or the image forming apparatus, a computer program for causing a computer to execute the belt driving control method, and a recording medium having the computer program for causing a computer to execute the method for controlling the drive of a belt in the belt driving control device.

2. Description of the Related Art

An image forming apparatus including various belts including a photoreceptor belt, an intermediate transfer belt, a sheet transfer conveyor belt, etc. is generally known to a person skilled in the art as one example of apparatuses utilizing belts. A high degree of accuracy in controlling the drive of the belt is a prerequisite for this type of image forming apparatus in order to insure high image quality. Below, one example of a tandem type electrophotographic image forming apparatus utilizing an intermediate transfer system will be described with reference to FIG. 1.

In the image forming apparatus as shown in FIG. 1, for example, four image forming units 18Y, 18M, 18C, and 18K that form corresponding homochromatic images in colors of yellow (Y), magenta (M), cyan (C), and black (K) are sequentially arranged along the direction of travel of a recording sheet that is being conveyed. Electrostatic latent images formed on surfaces of photoconductor drums 40Y, 40M, 40C, and 40K are then developed by exposure of laser from a laser exposure unit 21 at the corresponding image forming units 18Y, 18M, 18C, and 18K to form toner images (perceivable images). Subsequently, the homochromatic images formed on the surfaces of corresponding photoconductor drums 40Y, 40M, 40C, and 40K of the image forming units 18Y, 18M, 18C, and 18K are temporarily transferred on an intermediate transfer belt such that the homochromatic images are sequentially superimposed. Thereafter, toner of the superimposed images are fused and pressed by a fixation device 25, thereby forming color images fixated on the recording sheet.

In such an image forming apparatus, failure to maintain the travelling velocity of the recording sheet; that is, the travelling velocity of the intermediate transfer belt 10 at a constant value, results in color shifts. Such color shifts result from relative shifts in transferring positions of the homochromatic images that are alternately superimposed on the recording sheet. The color shifts may result in blurring fine line images formed by superimposing images of plural colors or white dot defects around profiles of black character images in the background image formed by superimposing images of plural colors.

In the image forming apparatus, including the aforementioned tandem type image forming apparatus, which utilizes a belt as a recording material transfer member for transferring a recording material or an image carrier such as a photoconductor or an intermediate transfer member to carry images transferred on the recording material, failure to maintain the travelling velocity of the belt at a constant value may result in banding. The banding indicates image density heterogeneity that results from fluctuations in the travelling velocity of the belt while images are being transferred on the recording material.

Specifically, a portion of the image transferred on the intermediate transfer belt 10 when the travelling velocity of the belt is relatively fast has a profile extended in a circumferential direction (i.e., travelling direction) of the belt whereas a portion of the image transferred on the intermediate transfer belt 10 when the travelling velocity of the belt is relatively slow has a profile shrunk in the circumferential direction of the belt, in comparison to the original profile of the image. The extended portion of the image has low density while the shrunk portion has high density.

As a result, the image density heterogeneity in the circumferential direction of the belt or banding is observed. The banding is significantly perceived with the naked eye when pale homochromatic images are formed.

Accordingly, in order to prevent the color shifts, banding, or the like, highly accurate driving control may be required for moving endless belts including the photoconductor belt, the intermediate transfer belt, a transfer conveyor belt, and the like at a constant travelling velocity. There is a technology for obtaining highly accurate driving control of the belt known to a person skilled in the art, in which a rotational velocity of a driving roller driving a belt is controlled at a constant value. In this method, the rotational velocity of the driving roller is maintained at a constant value by stabilizing a rotational angular velocity of a motor of a driving source, or a rotational angular velocity of a gear that transmits rotational driving force generated by the motor to the driving roller.

However, with the technology described above, even though the rotational angular velocity of the driving roller is maintained at a constant value, the travelling velocity of the belt may not always be kept at a constant value. This phenomenon is particularly significant when the thickness of the belt varies along the circumferential direction of the belt.

Japanese Patent Application Laid-Open No. 2006-106642 discloses a technology designed to minimize occurrences of such a phenomenon. In the disclosed technology, in order to form images while obtaining the amplitudes and phases of AC components of a rotational angular velocity and a rotational angular displacement of the belt having frequencies corresponding to fluctuation of the thickness of the belt in the circumferential direction, a driving signal output from a motor is converted into a rotational angular velocity of a driven roller. Subsequently, the driving signal output from the motor and the driving signal input to the motor is compared at a comparator to obtain a fluctuation component derived from a thickness fluctuation of the belt for one cycle rotation. The belt for one cycle rotation or one rotation hereinafter implies an entire length of the circular endless belt. Thereafter, a periodic fluctuation sampling section records the fluctuation component that results from the thickness fluctuation of the belt for one rotation on a memory. A fluctuation amplitude and phase detective section detects amplitudes and phases of a belt rotational component from the fluctuation component for one rotation of the belt recorded on the memory.

Note that there are also well known technologies in which the travelling velocity of the belt is controlled based on the fluctuation obtained by detecting the thickness of the belt in the circumferential direction (see Japanese Patent Application Laid-Open No. 2006-23403, Japanese Patent Application Laid-Open No. 2002-72816, Japanese Patent No. 2754582, and Japanese Patent Application Laid-Open No. 2004-20236).

In the disclosed technology of Japanese Patent Application Laid-Open No. 2006-106642, the driving signal output from the motor is compared with the driving signal input to the motor at a comparator so as to obtain a fluctuation component derived from the thickness fluctuation of the belt obtained for one rotation thereof. That is, in the technology of Japanese Patent Application Laid-Open No. 2006-106642, in order to obtain the fluctuation component and conduct a predetermined control on the motor based on the obtained fluctuation component, data on the thickness may be required for the entire length of the endless belt obtained from one rotation.

Specifically, according to the technologies of the related art, the belt needs to be driven for one rotation in order to sample the fluctuation component of the belt thickness (i.e., thickness deviation). However, with such technologies, even though printing is finished before the belt has made one rotation, the belt may still have to make one complete rotation only to sample data on the thickness deviations of the belt. Thus, it is inefficient to drive the belt only for obtaining data on the thickness deviation of the belt, because the life span of the entire image forming apparatus is reduced (trade-off relationship) for cancelling out the thickness deviation of the belt and improving driving control of the belt.

Thus, attempts have been made to correct deviations of the belt thickness without reducing the life span of the entire image forming apparatus.

SUMMARY OF THE INVENTION

Accordingly, embodiments of the present invention may provide a novel and useful belt driving control device, a belt device, an image forming apparatus, a method for controlling the drive of a belt conveyed in the belt driving control device, the belt device, or the image forming apparatus, a method for controlling the drive of a belt conveyed in the belt driving control device, the belt device, or the image forming apparatus, and a computer program for causing a computer to execute the belt driving control method, and a recording medium having the computer program for causing a computer to execute the method for controlling the drive of a belt in the belt driving control device, solving one or more of the problems discussed above.

In the embodiments of the invention, data on the thickness deviation of the belt are sampled by different methods according to whether or not the data on the thickness deviation of the belt for one rotation are required.

The embodiments of the invention attempt to provide a belt driving control device that includes an endless belt looped over a plurality of supporting rollers, a driving source configured to supply rotational driving force to one of the plurality of supporting rollers, a detecting section configured to detect a periodical thickness deviation of the endless belt in a circumferential direction and carry out data sampling for detection of the thickness deviation simultaneously with rotation of the endless belt, and a control section configured to control drive of the driving source such that the thickness deviation of the endless belt detected by the detecting section is canceled out, and control drive of the endless belt, upon detecting a predetermined condition, to drive the endless belt travel one rotation so as to obtain data samples on the thickness deviation for the one rotation of the endless belt by the data sampling.

Specifically, there is provided a belt driving control device according to an embodiment of the invention that includes an endless belt looped over a plurality of supporting rollers, a driving source configured to supply rotational driving force to one of the plurality of supporting rollers, a detecting section configured to detect a periodical thickness deviation of the endless belt in a circumferential direction of the endless belt and carry out data sampling for detection of the thickness deviation simultaneously with rotation of the endless belt, and a memory configured to store data on the thickness deviation of the endless belt obtained based on the data sampling. The belt driving control device further includes a control section configured to control drive of the driving source such that the detected thickness deviation of the endless belt by the detecting section is canceled out based on the data on the thickness deviation stored in the memory, and such that the endless belt is driven to travel one rotation upon detecting a predetermined condition even if the travel of the endless belt for one rotation is not needed for a printing purpose so as to carry out the data sampling for one rotation and update the data stored in the memory with new data obtained based on the data sampling.

Further, there is provided a method for controlling driving of a belt in a belt driving control device according to an embodiment of the invention including an endless belt looped over a plurality of supporting rollers, a driving source configured to supply rotational driving force to one of the plurality of supporting rollers, a control section configured to control drive of the driving source, and a detecting section configured to detect a periodical thickness deviation of the endless belt in the circumferential direction of the endless belt. The method includes carrying out first data sampling for the detection of the thickness deviation simultaneously with rotation of the endless belt, storing data on the thickness deviation of the endless belt obtained based on the first data sampling, and driving the driving source such that the detected thickness deviation is canceled out based on the stored data and such that the endless belt is driven to travel one rotation upon detecting a predetermined condition even if the travel of the endless belt for one rotation is not needed for a printing purpose so as to carry out second data sampling for one rotation and update the stored data with new data obtained based on the second data sampling.

There is provided a computer program for causing a computer to control a belt driving control device according to an embodiment of the invention including an endless belt looped over a plurality of supporting rollers, a driving source configured to supply rotational driving force to one of the plurality of supporting rollers, a control section configured to control drive of the driving source, and a detecting section configured to detect a periodical thickness deviation of the endless belt in the circumferential direction. The computer program for causing the computer to control the belt driving control device includes carrying out first data sampling for the detection of the thickness deviation simultaneously with rotation of the endless belt, storing data on the thickness deviation of the endless belt obtained based on the first data sampling, and driving the driving source such that the detected thickness deviation is canceled out based on the stored data and such that the endless belt is driven to travel one rotation upon detecting a predetermined condition even if the travel of the endless belt for one rotation is not needed for a printing purpose so as to carry out second data sampling for one rotation and update the stored data with new data obtained based on the second data sampling.

Further, according to an embodiment of the invention, there is provided a computer-readable storage medium storing the computer program for causing the computer to control the belt driving control device.

Additional objects and advantages of the embodiments will be set forth in part in the description which follows, and in part will be obvious from the description, or may be learned by practice of the invention. The object and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

DETAILED DESCRIPTION OF THE PREFERRED EMBODIMENTS

Figure 1:
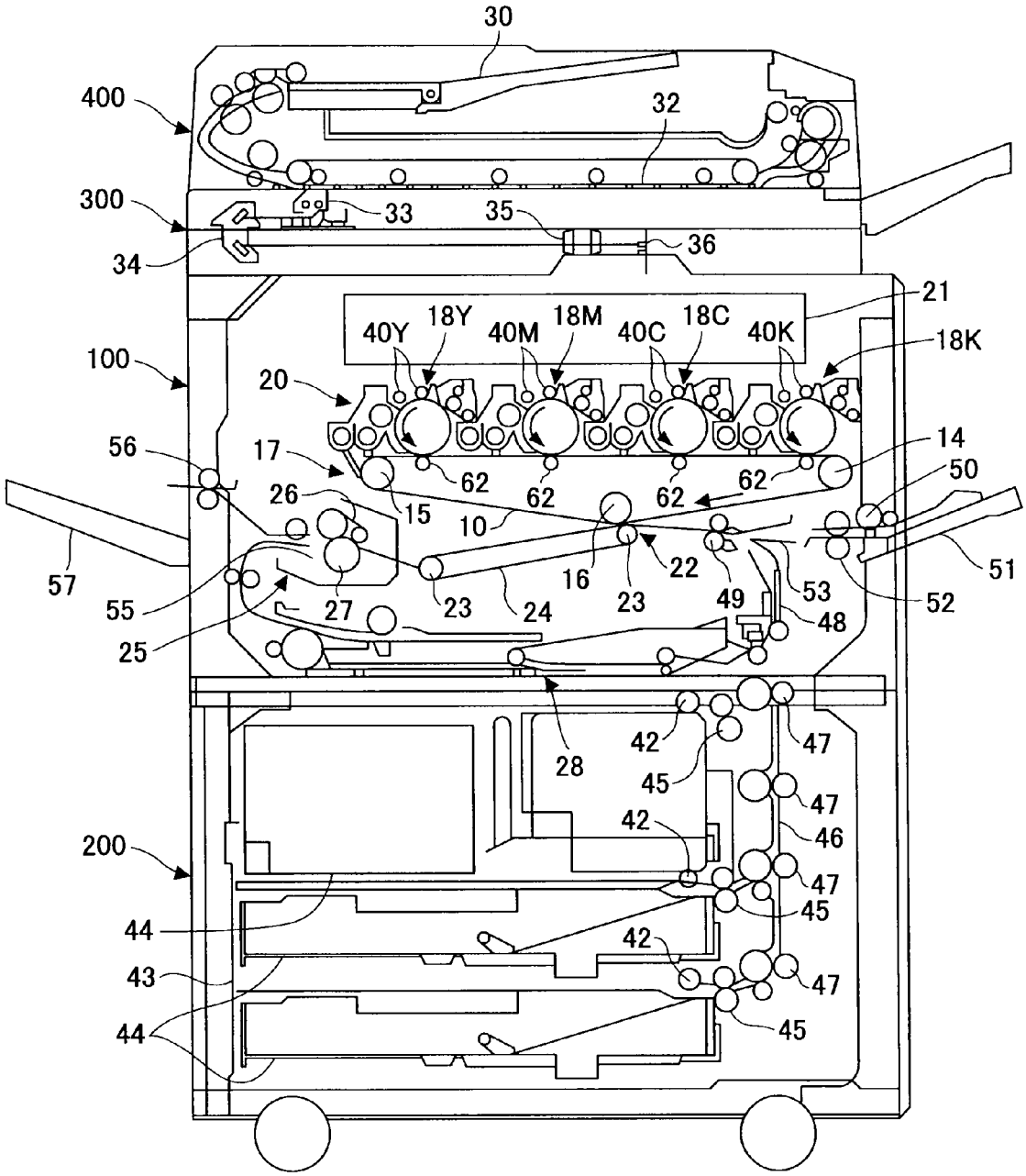
FIG. 1 is a view illustrating one example of a tandem type image forming apparatus according to an embodiment of the invention.

A description is given below, with reference to FIGS. 1 through 9 of embodiments of the present invention.

Note that in the embodiments described below, the supporting rollers represent a supporting roller 14 (driven roller), 15 (driving roller), and 16 (driven roller), the endless belt represents an intermediate transfer belt 10, the driving source represents a DC brushless motor M, the driving supporting roller represents the driving roller 15, the driven supporting roller represents the driven roller 14, the driven supporting roller detecting section includes an encoder E and a pulse counter 503, the driving supporting roller detecting section includes a motor FG and the pulse counter 503, an extraction section represents a phase-amplitude calculator 510, a control section includes a revise table calculator 513, an adder 515, a pulse generator 516, a counter represents a CPU 601, and an instruction section represents a control panel (not shown).

FIG. 1 is a schematic view illustrating one example of a copying apparatus given as an image forming apparatus according to an embodiment of the invention. In FIG. 1 reference numerals 100, 200, 300, and 400 respectively indicate a main body of a copying apparatus, a paper feeder on which the main body of the copying apparatus 100 is mounted, a scanner mounted on the main body of the copying apparatus 100, and an automatic document feeder (ADF) mounted on the scanner 300. The copying apparatus is a tandem type electrophotographic copying apparatus having an intermediate transfer (indirect transfer) system.

In the image forming apparatus according to the embodiment, the main body of the copying apparatus 100 includes an intermediate transfer belt 10 (a primary transfer belt), which is an intermediate transfer member utilized as an image carrier and located in the middle portion of the main body of the copying apparatus 100. The intermediate transfer belt 10 is looped over three rotational supporting members, that is, first, second and third supporting rollers 14, 15, 16, and rotationally travels in a clockwise direction. An intermediate transfer belt cleaning device 17 that removes residual toner remaining on the intermediate transfer belt 10 after the transfer of images on the intermediate transfer belt 10 is provided on the left side of the second supporting roller 15 of the three rollers as shown in FIG. 1.

A tandem type image forming device 20 includes four image forming units 18 corresponding to colors of yellow (Y), magenta (M), cyan (C), and black (K) that are sequentially arranged along a travel direction of the intermediate transfer belt 10. The image forming units 18 are arranged so as to face a portion of the intermediate transfer belt 10 located between the first and second supporting rollers 14 and 15. In the image forming apparatus according to the embodiment, the second supporting roller 15 is utilized as a driving roller. An exposure device 21 utilized as a latent image forming section is provided above the tandem type image forming device 20.

A secondary transfer device 22 is provided immediately beneath the intermediate transfer belt 10 such that the intermediate transfer belt is located between the tandem type image forming device 20 and the secondary transfer device 22. The secondary transfer device 22 includes two rollers 23 over which a secondary transfer belt 24 utilized as a recording material transfer member is looped. The secondary transfer belt 24 is arranged such that the secondary transfer belt 24 is pressed against the third supporting roller 16 via the intermediate transfer belt 10. The secondary transfer device 22 transfers images formed on the intermediate transfer belt 10 onto a sheet formed of the recording material member (i.e., the secondary transfer belt 24).

Further, a fixation device 25 that fixates the images transferred onto the sheet formed of the secondary transfer belt 24 is provided on the left side of the secondary transfer device 22 as shown in FIG. 1. The fixation device 25 includes a fixation belt 26 and a pressure roller 27 that are arranged such that the fixation belt 26 is pressed against the pressure roller 27. The aforementioned secondary transfer device 22 also includes a sheet transfer function that conveys the sheet of the secondary transfer belt 24 on which the images have been transferred to the fixation device 25.

A transfer roller or non-contact charger may be arranged in place of the secondary transfer device 22. In such cases, however, it may be difficult to arrange the secondary transfer device 22 in combination with the transfer roller or non-contact charger. In the image forming apparatus according to the embodiment, a sheet reversing device 28 is provided below the secondary transfer device 22 and fixation device 25, and arranged in parallel with the aforementioned tandem type image forming device 20. The sheet reversing device 28 is utilized for reversing the sheet of the secondary transfer belt 24 to thereby record images on both sides of the sheet.

When a user desires to make a photocopy of an original document using the aforementioned copying apparatus, the user places the original document on a document tray 30 of an automatic document feeder (ADF) 400. Alternatively, the user may lift up the ADF 400 to place the original document on a contact glass 32 of a scanner 300, and lift down the ADF to restrain the original document.

When the user places the original document on the document tray 30 of the ADF 400 and presses a start button (not shown) of the copying apparatus, the original document is transferred onto the contact glass 32. Alternatively, when the user places the original document directly on the contact glass 32 to photocopy and presses the start button, the scanner 300 is driven immediately. Subsequent to driving the scanner, a first running body 33 and a second running body 34 are caused to run.

Thereafter, light is emitted from a light source of the first running body 33 and reflected on a surface of the original document. The reflected light is directed towards the second running body 34 and further reflected on a mirror of the second running body 34. The reflected light from the second running body 34 is passed through an imaging lens 35 and then introduced into a reading sensor 36, which thereby reads the content of the original document.

While the reading sensor 36 is scanning the content of the original document, a driving motor operating as a driving source (not shown) rotationally drives the driving roller 15. The intermediate transfer belt 10 travels in the clockwise direction by rotation of the driving roller 15, and the remaining two supporting rollers (driven rollers) 14, 16 are subordinately rotated with the clockwise travel of the intermediate transfer belt 10.

Simultaneously, photoconductor drums 40Y, 40M, 40C, and 40K, utilized as latent image carriers, are rotated at corresponding image forming units 18, and latent images are exposed and then developed on the photoconductor drums 40Y, 40M, 40C, and 40K based on corresponding color information on yellow, magenta, cyan, and black, thereby forming homochromatic toner images (perceivable images) of the corresponding photoconductor drums 40Y, 40M, 40C, and 40K.

The homochromatic toner images formed on the corresponding photoconductor drums 40Y, 40M, 40C, and 40K are sequentially transferred onto the intermediate transfer belt 10 such that the homochromatic toner images are alternately superimposed on the intermediate transfer belt 10. As a result, a synthetic color image is formed on the intermediate transfer belt 10.

Simultaneously with such formation of a synthetic image, one of the paper supply rollers 42 of the paper feeder 200 is selectively rotated so as to feed out sheets of paper from one of the paper supply cassettes 44 arranged in multiple stages in a paper bank 43. One sheet of paper is separated by a separating roller 45 and fed to a paper supply path 46. The sheet of paper is then conveyed by conveyance rollers 47, and supplied to a paper supply path 48 inside the main body of the copying apparatus 100. The supplied sheet of paper is then brought into contact with a resist roller 49 to be stopped.

Alternatively, while also forming the synthetic image, a paper supply roller 50 is rotated so as to feed out sheets of paper on a manual bypass tray 51. One sheet of paper is separated by a separating roller 52 and fed to a manual bypass paper supply path 53. The supplied sheet of paper is then brought into contact with the resist roller 49 to be stopped. The resist roller 49 is rotated in synchronization with the formation of the synthetic color image on the intermediate transfer belt 10 to feed the sheet of paper between the intermediate transfer belt 10 and the secondary transfer device 22. The secondary transfer device 22 transfers the synthetic color image on the sheet of paper, thereby forming a color image.

The sheet on which the transferred color image is formed is conveyed to the fixation device 25 by the secondary transfer belt 24, and the fixation device 25 fixates the transferred color image by the application of heat and pressure. Thereafter, the position of the sheet on which the transferred color image is fixated is switched by a switching claw 55, and the sheet with the transferred fixated color image on it is discharged by a discharge roller 56, thereby stacking the discharged sheet on a discharge tray 57. Alternatively, the position of the sheet having the fixated color image is switched by the switching claw 55, and the sheet is supplied to a sheet reversing device 28. In the sheet reversing device 28, the sheet having the fixated color image on one side is reversed, and located at a position where an image is transferred and recorded on the other side of the sheet. The sheet now having the fixated color images on both sides is discharged by the discharge roller 56, thereby placing the discharged sheet on the discharge tray 57.

Residual toner remaining on the intermediate transfer belt 10 after the image transfer is removed by the intermediate transfer belt cleaning belt device 17 for subsequent image formation carried out by the tandem type image forming device 20. Note that the resist roller 49 is generally grounded; however, bias voltage may be applied to the resist roller 49 to eliminate powdery paper from the sheet.

The aforementioned copying apparatus may also produce monochrome photocopies. In this case, the intermediate transfer belt 10 is located at a position distant from the photoconductor drums 40Y, 40M, and 40C, following a certain procedure (not shown). In producing monochrome photocopies, the photoconductor drums 40Y, 40M, and 40C are temporarily stopped. Then, the photoconductor drum 40K alone is brought into contact with the intermediate transfer belt 10 to form and transfer images.

Next, driving control, which is one of the features of the embodiment of the invention, is described.

The copying apparatus according to the embodiment requires that the intermediate transfer belt 10 travels at a constant velocity. However, the travelling velocity of the belt, in practice, fluctuates with the thickness of the belt. If the travelling velocity of the intermediate transfer belt 10 fluctuates, there may be a difference between an actual position to which the intermediate transfer belt 10 travels and a target position to which the intermediate transfer belt 10 needs to travel. In such a condition, the end positions of the toner images formed on the corresponding photoconductor drums 40Y, 40M, and 40C may not be accurately matched with end positions of the toner images transferred on the intermediate transfer belt 10.

In addition, a portion of the toner image transferred on the intermediate transfer belt 10 when the travelling velocity of the belt is relatively fast has a profile extended in a circumferential (travelling) direction of the belt whereas a portion of the toner image transferred on the intermediate transfer belt 10 when the travelling velocity of the belt is relatively slow has a profile shrunk in the circumferential direction of the belt, in comparison to the original profile of the image. In such cases, in the image finally formed on the sheet of paper, heterogeneous density or banding is periodically formed in a direction corresponding to the circumferential direction of the belt.

According to the embodiment of the invention, the intermediate transfer belt 10 is controlled with high accuracy such that the intermediate transfer belt 10 can travel at a constant velocity. Descriptions of a configuration in which the intermediate transfer belt 10 can be rotated at a constant velocity with high accuracy follow. Note that the descriptions given below are not limited to the intermediate transfer belt 10 but include various belts subjected to drive control in a wide range of use.

Figure 2:
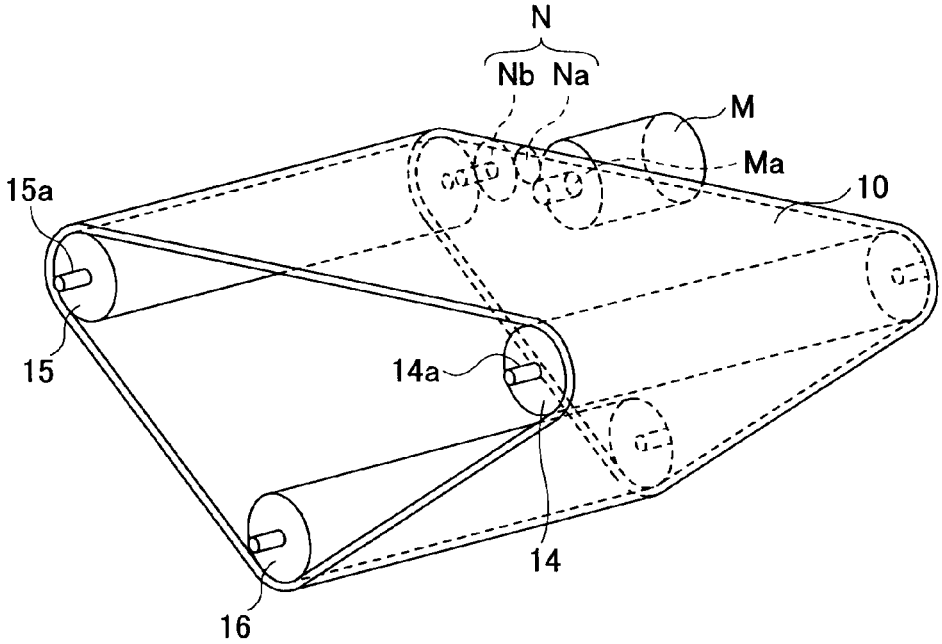
FIG. 2 is a schematic perspective diagram illustrating major components of an intermediate transfer belt in FIG. 1.

FIG. 2 is a configuration diagram illustrating major components of the intermediate transfer belt 10. A shaft 15*a* of a transfer driving roller 15 is connected to a driving gear N via reduction gears Na and Nb engaged with a gear of a rotational shaft Ma of a transfer driving gear motor M. The transfer driving motor M is rotationally driven such that the shaft 15*a* rotates in proportion to driving velocity of the transfer driving motor M. The intermediate transfer belt 10 is driven by rotating the transfer driving roller 15, and a driven roller 14 is rotated by driving the intermediate transfer belt 10. According to the embodiment, an encoder (not shown) is provided on the shaft 14*a*. The encoder detects a rotational velocity of the driven roller 14, and a rotational velocity of the transfer driving motor M is controlled based on the detected rotational velocity of the driven roller 14.

Further, according to the embodiment, a target rotational velocity of the transfer driving roller 15 is determined in advance, the rotational velocity of the driven roller 14 is PLL (Phase-Locked Loop)-controlled (i.e., controlling velocity) such that the determined target rotational velocity of the transfer driving roller 15 is synchronized with the detected rotational velocity of the driven roller 14 detected by the encoder. In the PLL control according to the embodiment, the target rotational velocity of the transfer driving roller 15 is controlled based on a control gain in order to improve tracking capability of the fluctuation of detected velocity.

The fluctuation in the travelling velocity of the intermediate transfer belt 10 is minimized by conducting the PLL control, thereby suppressing the generation of the color shifts.

However, with the PLL control method utilizing the encoder, the driving velocity of the transfer driving motor M is controlled by the application of the control gain as described above. If the detected rotational velocity includes errors that vary with the thickness of the belt, the transfer driving motor M may unfortunately be driven based on amplified errors of the detected rotational velocity. That is, the fluctuation of the thickness of the intermediate transfer belt 10 results in the fluctuation of the velocity of the belt, thereby generating the color shifts in images formed on the intermediate transfer belt 10.

Figure 4:
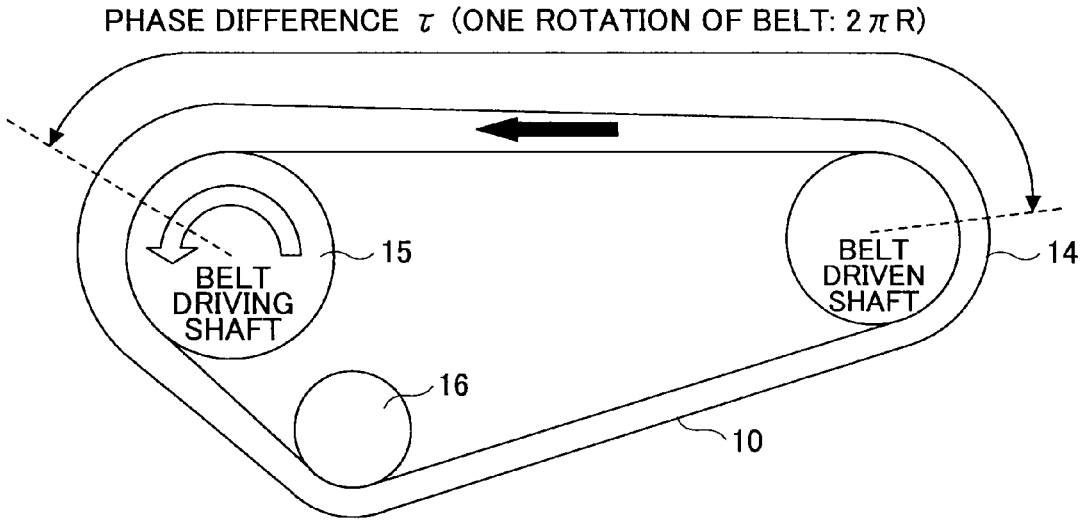
FIG. 4 is a diagram illustrating one example of a configuration of a belt conveyor system.

Details of generation of the color shifts are described with reference to FIG. 4.

Here, it is presumed that the transfer driving motor M is driven at a constant velocity and the intermediate transfer belt 10 is ideally conveyed without fluctuation of the velocity. If the thicker portion of the intermediate transfer belt 10 is looped over the driven roller 14, the effective driven radius of the intermediate transfer belt 10 is increased, thereby reducing a displacement amount of the rotational angle of the driven roller 14. The decreased displacement amount of the rotational angle is detected as a decrease in the belt conveyance velocity. In contrast, if the thinner portion of the intermediate transfer belt 10 is looped over the driven roller 14, a displacement amount of the rotational angle of the driven roller 14 is increased, which is detected as an increase in the belt conveyance velocity.

Figure 5:
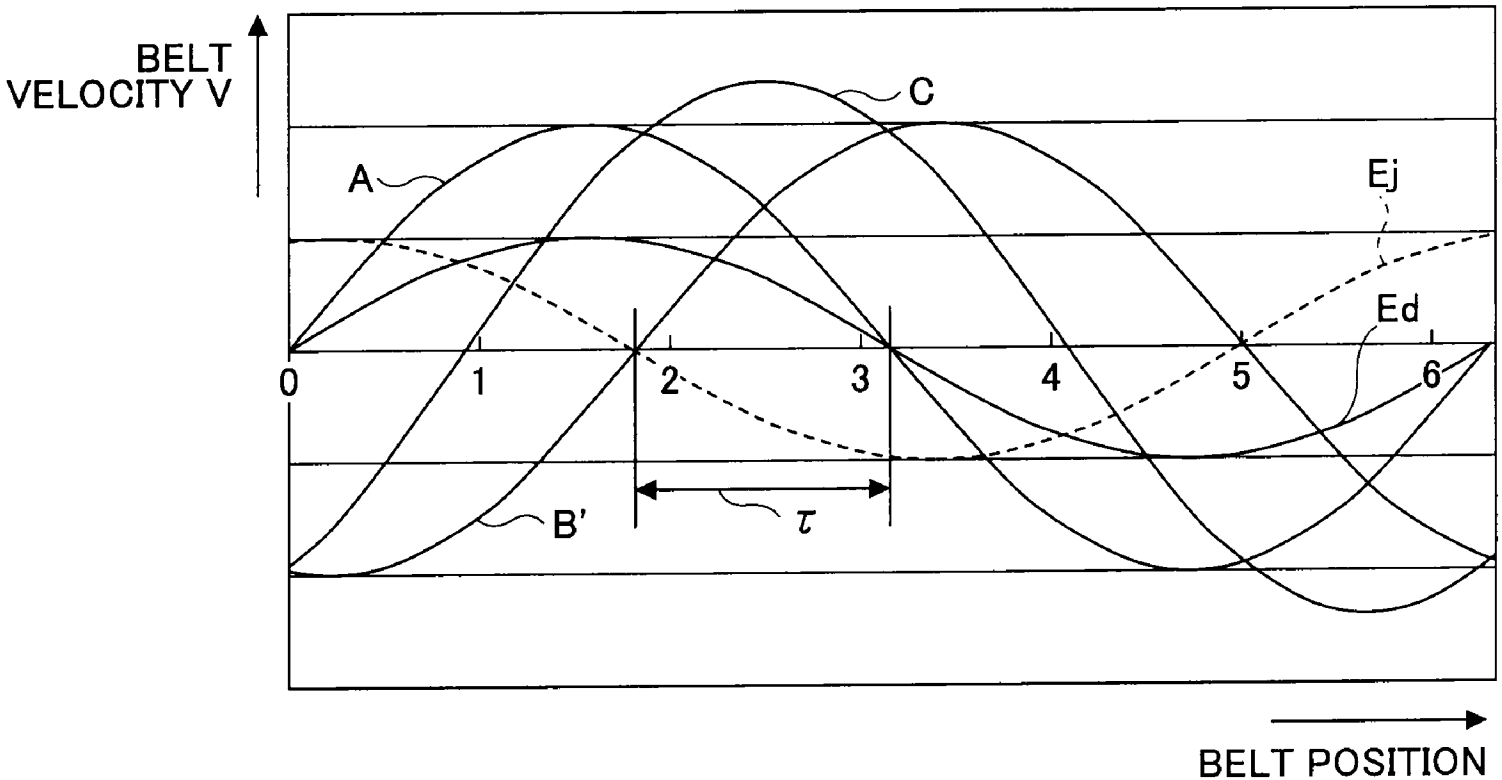
FIG. 5 is a graph illustrating a relationship between a thickness variance of a belt and an angular velocity fluctuation of a roller shaft.

FIG. 5 shows a case where the belt conveyance velocity is maintained at a constant value by varying the angular velocity of the driving roller.

In FIG. 5, "A" indicates the conveyance velocity of the belt obtained when the driving roller 15 is rotated at a constant rotational angular velocity. "C" represents the rotational angular velocity of the driven roller 14 obtained when the driving roller 15 is rotated at a constant rotational angular velocity. "B'" represents the rotational angular velocity of the driven roller 14 obtained when the belt is rotated at a constant conveyance velocity. "Ej" represents an effective thickness fluctuation of the belt on the driven roller 14 in FIG. 4. "Ed" represents an effective thickness of the belt on the driving roller 15.

As shown in FIG. 5, the rotational angular velocity C of the driven roller 14 while rotating the driving roller 15 at a constant rotational angular velocity is obtained by superimposing the rotational angular velocity B' of the driven roller 14 obtained while rotating the belt at a constant conveyance velocity on the conveyance velocity A of the belt while rotating the driving roller 15 at a constant rotational angular velocity.

If the conveyance velocity of the belt is constant, the rotational angular velocity of the driven roller 14 has a waveform having a phase shifted π from the waveform A shown in FIG. 5. In this case, the rotational angular velocity of the driven roller 14 is shown by the waveform B' in FIG. 5. Accordingly, the difference between the rotational angular velocity of the driving roller 15 (shifted π from waveform A) and that of the driven roller 14 (waveform B') results in a waveform C, which represents the rotational angular velocity of the driven roller 14 while rotating the driving roller 15 at a constant velocity.

For facilitating comprehension, the aforementioned description is based on the assumption in which the conveyance velocity of the belt is maintained at a constant value; however, the subtraction of the rotational angular velocity of the driven roller 14 from that of the driving roller 15 results in the waveform C (i.e., the rotational angular velocity of the driven roller 14 while rotating the driving roller 15 at a constant velocity).

Specifically, even though the rotational angular velocity of the driving roller 15 (shaft) fluctuates, by subtracting the rotational angular velocity of the driving roller 15 from that of the driven roller 14 a fluctuation component resulting from fluctuation of the belt thickness can be obtained in the same manner as the fluctuation component obtained by rotating the driving roller 15 at a constant velocity.

The fluctuation in the rotational angular velocity of the driven roller 14 resulting from fluctuation of the belt thickness is computed based on data obtained by measuring fluctuation of the rotational angular velocity (angular displacement) of the driven roller 14 and that of the driving roller 15. Thereafter, a target control value to control the driving roller 15 at a constant conveyance velocity is set based on the computed data, and the angular velocity of the driving roller 15 is controlled based on a comparison result between the target control value of the driving roller 15 and an output value of a rotary encoder of the driven roller 14.

In this case, a control parameter to be employed is not the thickness of the transfer belt actually measured per μm but is an angular displacement error resulting from the fluctuation of the thickness of the belt detected per radian by the encoder.

Thus, since the control parameter is generated based on the outcome generated from the driving roller 15 and the encoder on the driven roller 14, the actual image forming apparatus may also generate the control parameter. As a result, the image forming apparatus may be manufactured at a low cost without a gauge for measuring thickness of the belt.

Note that the actual result output from the encoder includes the fluctuation and rotational deflection of the driving roller 15 and other configuration devices in addition to the angular displacement error detected due to the belt thickness. Thus, only the component that affects the driven roller is extracted from the result output from the encoder, and the extracted component is set as the control parameter for the detected angular displacement error.

Figure 3:
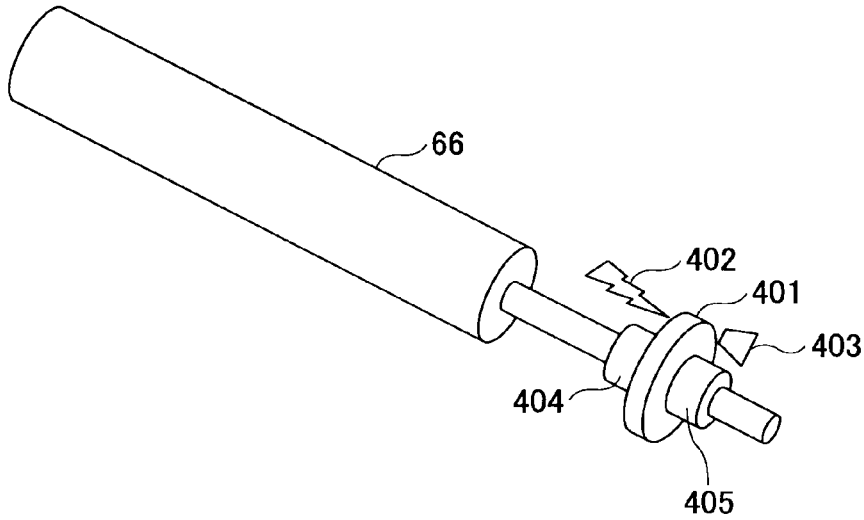
FIG. 3 is a schematic diagram illustrating details of an essential portion including a driven roller and an encoder.

FIG. 3 illustrates details of the driven roller 14 and the encoder. The encoder 501 includes a disk 401, a light-emitting device 402, light receiving device 403, and press-fitting bushes 404 and 405. The disk 401 is secured by press-fitting the press-fitting bushes 404, 405 on a shaft of a lower right roller 66 that is in contact with the driven roller 14, so that the disk 401 is rotated in line with the driven roller 14. The disk 401 includes slits in a circumferential direction that transmit light at a resolution of several hundred units. The disk 401 further includes the light emitting device 402 and the light receiving device 403 located at one of both sides so as to obtain on-off pulsed signals in compliance with the number of rotations of the driven roller 14. A driving amount of the transfer driving motor M is controlled by detecting a travelling angle (hereinafter referred to as "angular displacement") of the driven roller 14 based on the on-off pulsed signals.

Figure 6:
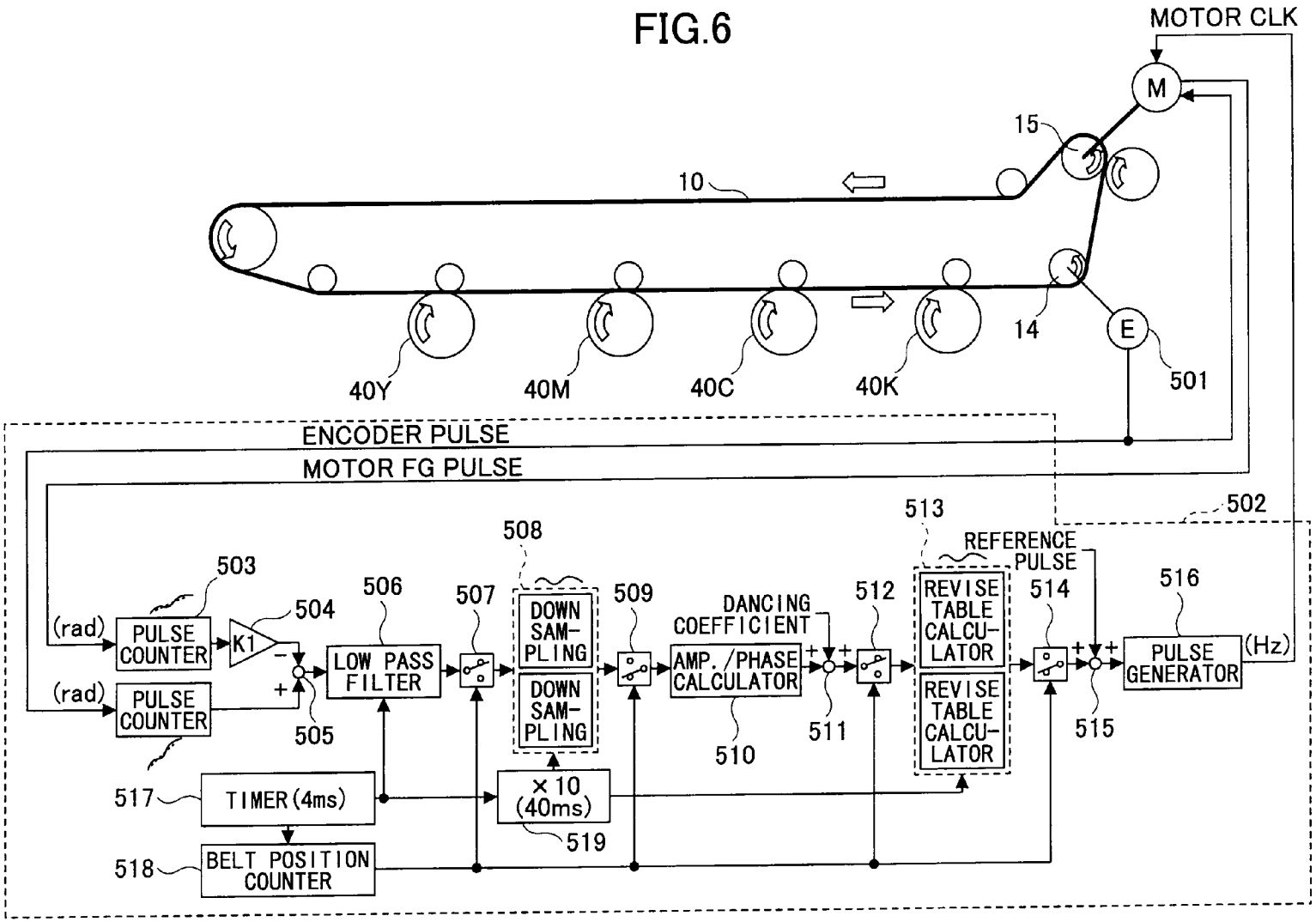
FIG. 6 is a block diagram illustrating a control configuration to execute a feedback control for a transfer belt and a correction control for the belt thickness variance according to an embodiment of the invention.

FIG. 6 is a block diagram of a driving control device of the copying apparatus according to the embodiment. In FIG. 6, the angular displacement signal of the transfer driving motor M and the detected displacement signal of the encoder 501 are input to the controller section 502. Note that the embodiment employs a brushless DC motor for the transfer driving motor, and utilizes a FG signal detecting the rotational velocity of a rotor of the motor as the angular displacement signal of the transfer driving motor M. However, the angular displacement signal of the transfer driving motor M may be obtained by the encoder mounted on the motor shaft.

The controller section 502 mainly includes a pulse counter section 503 that counts the number of pulses of the angular displacement signal generated by the driving motor M and the number of pulses (encoder pulse) of the detected angular displacement signal generated by the encoder 501, and a subtractor section 505 that computes the difference between the counted pulse of the driving motor M and that of the encoder 501. The controller section 502 further includes a low-pass filter 506 that removes a high frequency noise from the difference (subtracted result), a data reduction memory 508 that downsamples the subtracted result obtained after the low-pass filter and temporarily stores the result of downsampled data obtained from one rotation of the belt (i.e., entire length of the circular endless belt), a phase-amplitude calculator 510 that extracts a fluctuation component of the belt thickness (thickness deviation) from the downsampled result obtained from one rotation of the belt, a revise table calculator 513 that computes correction values based on the computed phase and amplitude values and arranges the correction values in the table, and a pulse generator 516 that generates a pulse signal assigning to the motor by retrieving the correction value from the correction table.

The pulse counter section 503 carries out processing of counting the number of pulses of the angular displacement signal generated by the driving motor M and the number of pulses of the detected angular displacement signal generated by the encoder 501. The counting of the pulses is carried out by detecting edges of a pulse signal and counting the number of edges input to the hardware. In this process, since the resolution capability of the motor FG differs from that of the encoder, a multiplier section 504 multiplies a constant to the counted pulses of the motor FG so that both the motor FG and the encoder have the same resolving power.

Thereafter, the subtractor section 505 computes the difference between the counted results. According to the embodiment, the copying apparatus includes a 4 ms-timer 517 that refers each of the pulse counter values for every 4 ms. The obtained difference is stored in the memory of the low-pass filter section 506 for every 4 ms. Note that in this embodiment, the difference is computed for every 4 ms, however, not limited to every 4 ms. Higher rates of sampling may be accepted to lower the quantized errors of the sampled data sets. Time to compute the difference is determined based on a pulse generation cycle determined by the resolutions of the motor FG and the encoder, and securable capacity of the internal memory.

The output results each include components of periodic fluctuations of the rollers and the driving gears, and a component of a periodic fluctuation of the belt thickness, so that the components of periodic fluctuations of the rollers and the driving gears, excluding the component of the periodic fluctuation of the belt thickness, are removed from the differences sampled for every 4 ms in moving average processing. In this embodiment, in order to cancel out the periodic fluctuation component of the driving roller 15 that is relatively analogous to the periodic fluctuation component of the belt, the memory having capacity of storing the aforementioned differences obtained from two rotations of the driving roller 15 (i.e., obtained twice from the entire length of the circular endless belt) is prepared for carrying out the moving average processing. The periodic fluctuation of the belt that is superimposed with the fluctuation component analogous thereto may result in computational errors while computing the phases and amplitudes described below, so that the periodic fluctuation component of the driving roller 15 is canceled out in advance.

A set of data obtained in two rotations of the belt is taken out for every 40 ms counted by a synchronous timer 519 from the data obtained through the moving average processing, and the sets of data taken out for every 40 ms are then temporarily stored in the data reduction memory 508. In the moving average processing, data sets are sampled for every 4 ms of relatively fast cycles in order to reduce the quantized errors. However, in the computation of phases and amplitudes, not many sampled data sets are required for computation of the phases and amplitudes in one rotation of the belt, provided that the data sets are not superimposed with other fluctuation components than the periodic fluctuation component of the driving roller 15. Accordingly, a set of data is taken out from the data obtained via the moving average processing for every 40 ms to be stored in the data reduction memory 508.

In subsequent processing conducted at a phase-amplitude processor 510, positional control based on reference positions of the transfer belt 10 may be required for computing the phases. Therefore, the reference positions can be managed by providing reference marks on the transfer belt 10, sampling the data sets while detecting the reference positions with sensors. However, in this embodiment, the reference positions are controlled as follows: a 4 ms-timer counts pulse counter values for every 4 ms counted, and virtual reference positions are determined as points at a time when the 4 ms-timer starts computing the aforementioned differences. Thereafter, the number of rotations of the belt and the reference positions are computed based on the counted values obtained for every 4 ms.

The data sets obtained from one rotation of the belt are stored in the data reduction memory 508, and a phase and the maximum amplitude are computed by the reference position of the phase-amplitude computing processor 510 as described above. Higher order components of the periodic fluctuation of the transfer belt 10 may be obtained by the computation of phases and amplitudes so that in this embodiment, the first to third order components are computed.

Orthogonal detection processing is conducted for the computation of phases and amplitudes. A basic concept of the orthogonal detection processing is illustrated as follows. Generally, in the waveform that changes periodically in a time-domain, provided that the cycle of waveform is assumed as T:

The fundamental frequency $f_0=1/T$

The fundamental angular frequency $\omega_0=2\pi f0$

Thus, the discrete data are expressed by the following equation (1) as Fourier series.

$$x(t) = a_0 + a_j\cos\omega_0 t + \ldots + a_n\cos n\omega_0 t + b_1\sin\omega_0 t + \ldots + b_n\sin n\omega_0 t = a_0 + \sum_{n=1}^{\infty}(a_n\cos n\omega_0 t + b_n\sin n\omega_0 t) \quad (1)$$

$$(n = 1, 2, 3 \ldots \infty)$$

The components are computed by the following equation (2).

$$a_0 = \frac{1}{T}\int_0^T x(t)\,dt \quad (2)$$

$$a_n = \frac{2}{T}\int_0^T x(t)\cos n\omega_0 t\,dt$$

$$b_n = \frac{2}{T}\int_0^T x(t)\sin n\omega_0 t\,dt$$

Note that in the equation (2), $a_0$ represents a DC component, $a_n$ and $b_n$ individually represent amplitudes of a cosine wave and a sine wave each having an angular frequency of $\omega_0$.

$$x(t) = \sum_{n=1}^{\infty} r_n\cos(n\omega_0 t - \phi_n) \quad (3)$$

$$r_n = \sqrt{a_n^2 + b_n^2}$$

$$\phi_n = \tan^{-1}\frac{b_n}{a_n}$$

In the above equation (3), $r_n$ and $\phi_n$ individually represent the amplitude and phase of the $n^{th}$ order harmonics.

The amplitude and phase are computed as follows: first, the sine and cosine computations are individually performed on the discrete data sets stored in the data reduction memory 508 based on the frequency f of one rotation of the transfer belt and data sampling time t of the discrete data sets. The amplitudes $a_n$ and $b_n$ of the cosine wave and the sine wave are subsequently computed based on accumulated data sets. The amplitude $r_n$ and phase $\phi_n$ are computed by the equation (3) thereafter.

The aforementioned computed results include errors detected from the driving roller 15 and driven roller 14. The amplitudes are corrected by the application of the conversion factor uniquely determined based on a mechanical layout of a transfer unit (secondary transfer device 22), and the errors detected from driven roller 14 are corrected based on the corrected amplitudes. Thereafter, the first to third error components of phases and amplitudes detected from the driven roller 14 are computed, and synthesized waves of the corresponding components are computed based on a sine function. Thus, the correction of the amplitudes for one rotation of the belt is computed by a correction table computing section 513.

Having computed values in the correction table by the correction table computing section 513, a pulse generator 516 generates a pulse signal output to the transfer driving motor M. At that moment, the pulse generator 516 reads the values from the correction table computing section 513 by switching reference addresses based on the travelled positions of the belt.

The values computed by the correction table computing section 513 include the differences between the counted values of the motor FG and those of the encoder. The frequency supplied to the driving motor M is determined by converting the difference (counted value) into a corresponding frequency and adding the obtained frequency to an original frequency. The pulse signal supplied to the driving motor M is thus generated based on the resulting frequency.

The aforementioned operations are reiterated for every rotation of the belt so that errors detected from the driven roller 14 due to the fluctuation of the belt thickness can be extracted from the data sets output from the motor FG and the encoder. The detected errors are converted into the corresponding frequencies, and the PLL control of the DC motor operates based on the obtained frequencies. As a result, the belt can travel at a constant velocity.

Note that in FIG. 6, reference numerals 511 and 515 represent adders and reference numerals 507, 509, 512, and 514 represent switches to operate based on counted positions counted by a belt position counter 518 to select connection directions.

Figure 7:
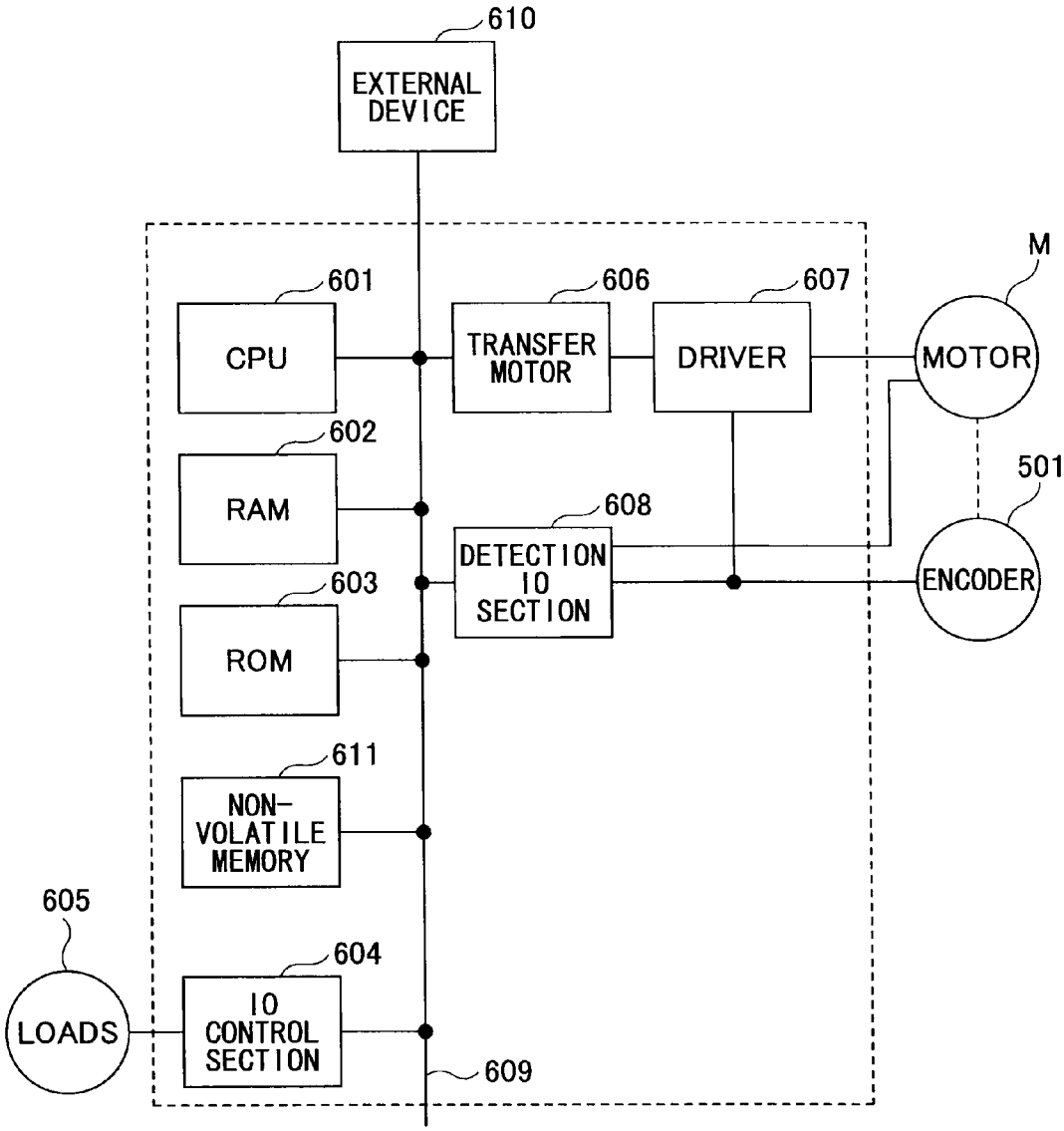
FIG. 7 is a block diagram illustrating a hardware configuration of a control system for a transfer driving motor and components subjected to control according to the embodiment of the invention.

FIG. 7 is a block diagram illustrating a hardware configuration of a control system for a transfer driving motor M and components subjected to control. The control system performs digital control on driving pulses of the transfer driving motor M based on a signal output from the aforementioned encoder 501. The control system includes CPU 601, RAM 602, ROM 603, a non-volatile memory 611, an IO control section 604, a transfer driving motor driving IF section 606, a driver 607, and a detection IO section 608.

The CPU 601 controls an entire image forming apparatus including controlling transmission and reception of control commands, and image data supplied from an external apparatus 610. The RAM 602 utilized as a work area, ROM 603 storing programs, and IO control section 604 are mutually connected via a bus such that various operations including reading and writing data, and driving motors, clutches, solenoids, sensors, and the like that drive corresponding loads based on instructions assigned from the CPU 601. The CPU 601 executes controls defined in a program by executing processing of the program in the RAM 602 utilized as the work area based on program codes stored in the ROM 603.

The transfer driving motor IF 606 outputs instructive signals to the driver 607 to direct a driving frequency of a driving pulse signal, based on driving instructions assigned from the CPU 601. As a result, the driver 607 conducts the PLL control based on the directed frequency to rotationally drive the transfer driving motor M.

The signal output from the encoder 501 and the FG signal output from the motor M are supplied to the detection IO section 608. The detection IO section 608 carries out processing on pulses output from the encoder 501 and the motor M and converts the pulses into digital numeric values. The detection IO section 608 includes a counter counting the number of output pulses. The counted values counted by the counter are transmitted to the CPU 601 via the bus 609.

The aforementioned transfer driving motor driving IF section 606 generates a pulsed control signal based on the instructive signal, including the driving frequency, transmitted from the CPU 601.

The driver 607 includes a PLL control IC, a power semiconductor device (e.g., transistor), and the like. The driver 607 is PLL controlled based on the pulsed control signal output from the transfer driving motor driving IF section 606 and rotational information from the driven roller (shaft) 14 such that the driven roller (shaft) 14 has the same phase and amplitude of the rotational angular velocity as those of the control signal of the driving roller (shaft) 15. The transfer driving motor M is provided with an in-phase signal based on the frequency of the driving pulse signal generated by the PLL control. As a result, the driven roller (shaft) 14 is drive-controlled based on a predetermined driving frequency output from the CPU 601. Accordingly, the disk 401 is controlled so as to follow a target angular displacement, and hence the driven roller (shaft) 14 rotates at a predetermined constant angular velocity. The encoder 501 and detection IO section 608 detect the angular displacement of the disk 401, and the CPU 601 obtains the detected displacement of the disk 401. The PLL control is reiterated in this manner.

The RAM 602 is utilized as a work area in which a program stored in the ROM 603 is executed, a data storage area in which a noise component is eliminated by the low-pass filtering based on the difference between the signal of the encoder and the FG signal of the transfer driving motor M, and a storage area to store correction values. Since the RAM 602 is a volatile memory, parameters such as phases and amplitudes that are required for the subsequent initiation of the belt are stored in non-volatile memory 611 such as EEPROM. The data (parameters) of one cycle (rotation) of the transfer belt 10 are deployed on the RAM 602 based on a sine function or the like when the power is turned on or the transfer driving motor is activated.

The actual thickness of the transfer belt 10, though largely complied with during the manufacturing process, exhibits a sine wave in most cases. Thus, not all data, specifically not all the data on the detected angular displacement errors obtained from one rotation of the transfer belt may need to be stored. The phases and amplitudes of the belt thickness are computed based on the reference positions of the belt while the thickness of the belt is being measured. The data on the detected angular displacement errors can be computed based on the computed phases and amplitudes. The computed data on the detected angular displacement errors are sufficiently equivalent to all the data on actually detected angular displacement errors and can be used as actually detected angular displacement errors. Thus, the data on the detected angular displacement errors need not be stored in the non-volatile memory 611 for every cycle (rotation) of the belt, because the data on the detected angular displacement errors due to the fluctuation of the belt thickness can be generated based on the phase and amplitude parameters alone, which are computed from the reference positions of the belt. Accordingly, only the area for the volatile memory may be required for controlling the transfer driving motor M. The data on the detected angular displacement errors due to the fluctuation of the belt thickness are generated on turning on the power or activating the transfer driving motor.

According to the embodiment, the thickness deviation of the intermediate transfer belt is computed and corrected based on the data on the detected angular displacement errors obtained from one rotation of the belt in this manner. According to the embodiment of the invention, a method of correcting color shifts includes the following steps:

1) When the belt is driven, the encoder attached to the driven roller of the belt detects, the velocity of the belt based on the detected velocity obtained from one rotation of the belt, and a deviation detecting module indirectly computes the thickness deviation of the belt required for one rotation of the belt.

2) A device module determines a driving amount of the driving roller required in a subsequent rotation of the belt based on the computed thickness deviation obtained from one rotation of the belt.

3) The aforementioned operations 1) and 2) are reiterated for every rotation of the belt.

Figure 8:
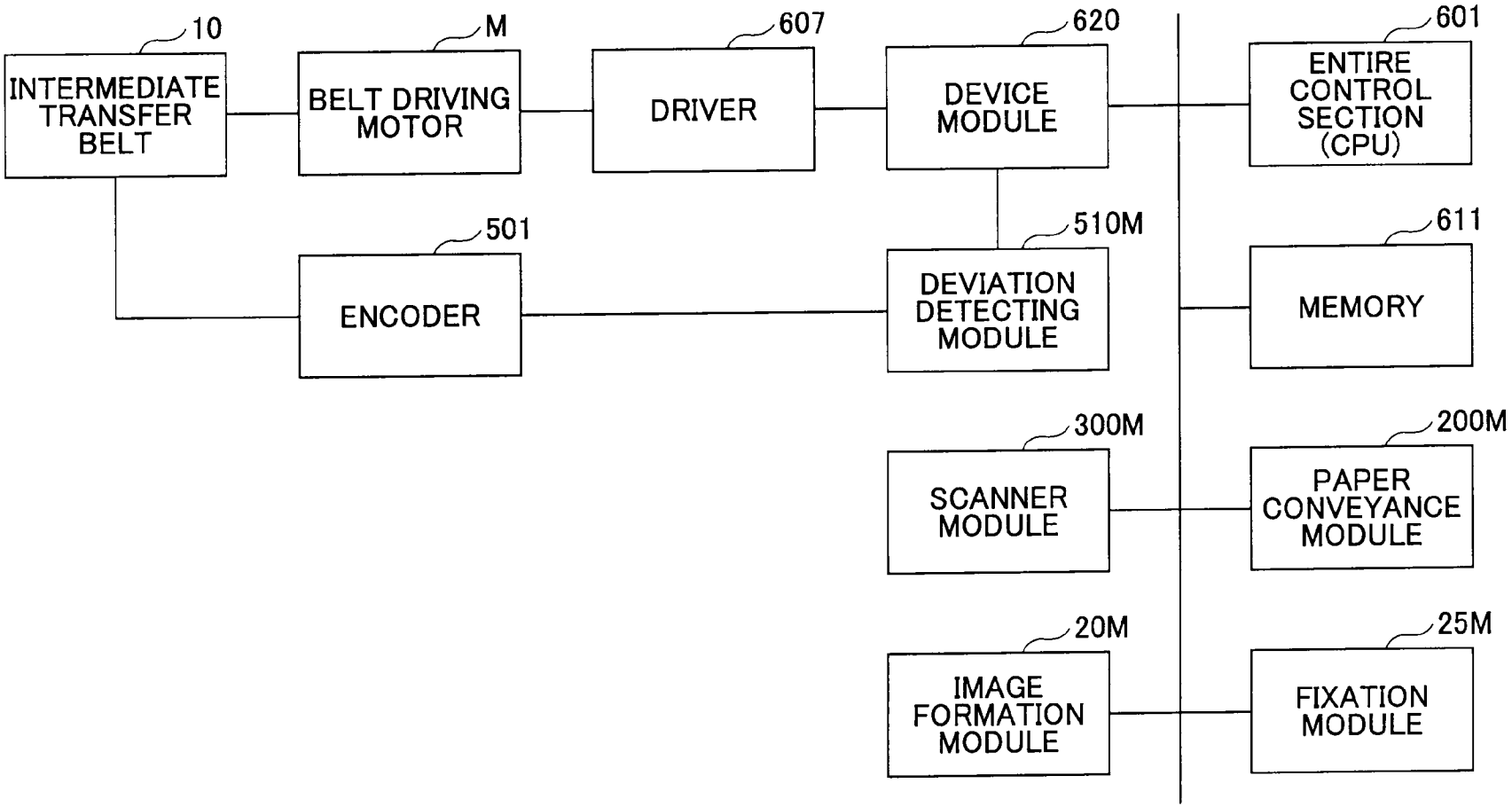
FIG. 8 is a block diagram illustrating software modules for a tandem image forming apparatus (copying apparatus) according to the embodiment of the invention.

FIG. 8 is a block diagram illustrating a software module configuration of a copying apparatus 100 executing such operations. In FIG. 8, an entire control section (CPU) 601 controls the entire copying apparatus 100. The entire control section 601 is connected with a memory 611, a paper conveyance module 200M, a fixation module 25M, a device module 620, a scanner module 300M, and an image formation module 20M via a bus so as to transmit and receive signals between the entire control section 601 and these modules. The device module 620 is connected with a deviation detecting module 510M and a driver 607. The deviation detecting module 510M corresponds to the phase-amplitude calculator 510 that is supplied with the signals obtained through the aforementioned operations based on output signals of the encoder 501 attached to the supporting roller 14 of the driven shaft of the intermediate transfer belt 10. The intermediate transfer belt 10 is rotationally driven by the driving force of the belt driving motor M driven by the device module 620 and the driver 607.

The method for correcting the thickness deviation of the intermediate belt 10 when driving the intermediate transfer belt 10 is already described above. The data on the thickness deviation of the intermediate transfer belt obtained from one rotation of the belt are required to correct the thickness deviation of the belt. In this case, the roller may have to be rotated for one rotation of the belt. The roller is driven simultaneously with printing; however, in a case where the printing has finished before the roller is driven to rotate for one rotation of the belt, the belt may have to be rotationally driven only for obtaining the data. When the belt has made one rotation, the image forming apparatus is stopped.

If aforementioned operation is repeated for each time the belt is driven, the life span of the image forming apparatus may be reduced. In the copying apparatus 100 of this embodiment, the following steps are conducted as shown in a flowchart in FIG. 9. The flowchart in FIG. 9 shows control steps in which the belt is moved for one rotation if detecting thickness deviation of the belt is required, whereas if the thickness deviation will properly be canceled out without rotating the belt for one rotation this time, then the belt is stopped.

Figure 9:
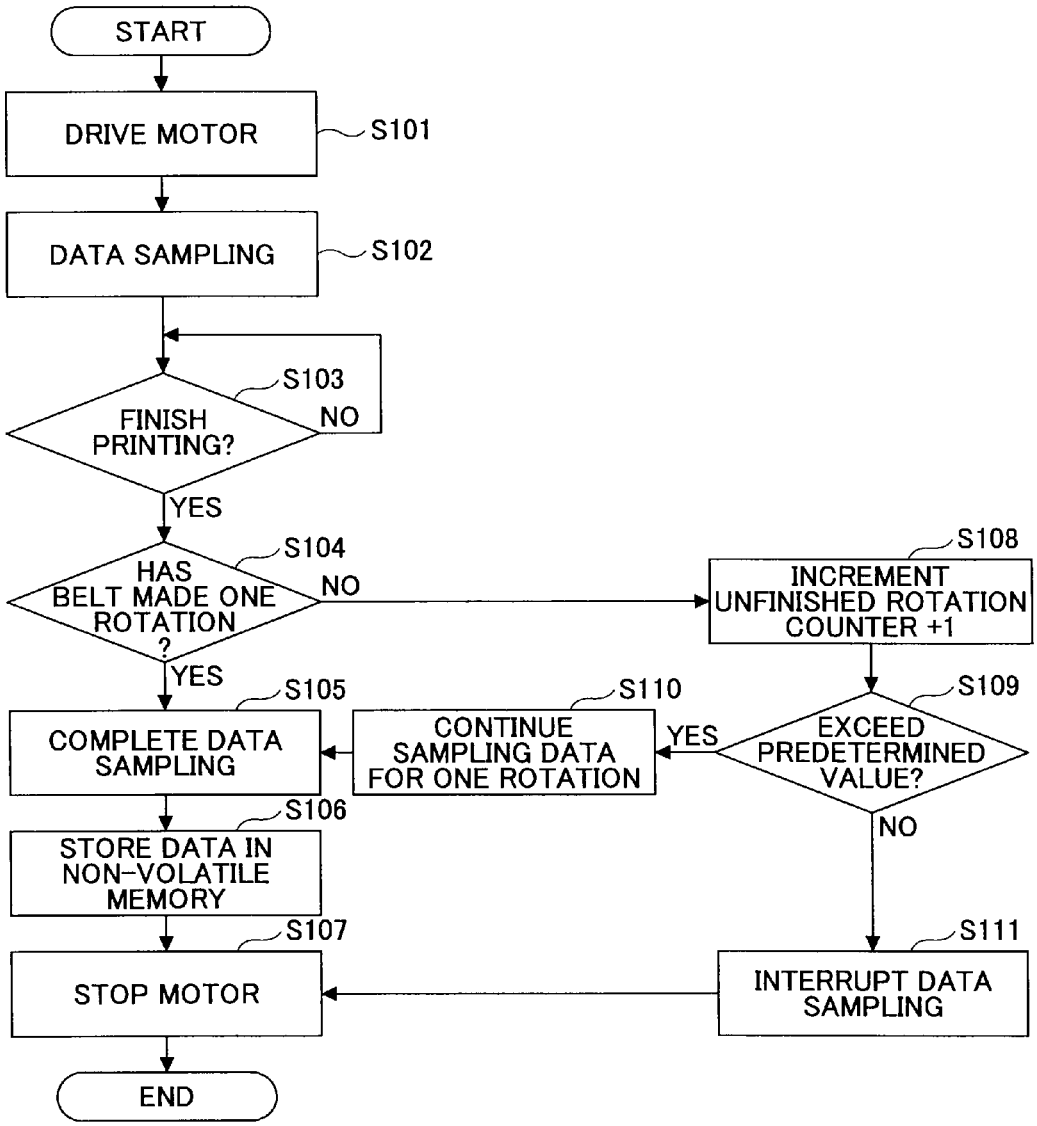
FIG. 9 is a flow-chart illustrating control steps conducted in the control system according to the embodiment of the invention.

As shown in the flowchart in FIG. 9, the entire control section 601 drives the motor M (step S101), and waits finishing of printing (step S103) while sampling data at the controller section 502 (see FIG. 6) (step S102). The entire control section 601 checks, when printing is finished, whether the intermediate transfer belt 10 has made one rotation. If the belt has made one rotation, the entire control section 601 completes sampling data (step S105) and stores the sampled data in non-volatile memory (step S106) and stops driving the motor M (step S107). In contrast, if the belt has not made one rotation when printing is finished (step S104-N), the entire control section 601 deactivates the image forming apparatus and the intermediate transfer belt 10. At the same time, the entire control section 601 increments an unfinished rotation counter by one (+1) (step S108).

In the subsequent printing, when the unfinished rotation counter indicates a non-zero value, the drive of the driving roller 15 is corrected based on data obtained from the last one rotation of the belt. Such data are retrieved from the non-volatile memory 611. Since the data are old, the accuracy of the correction may inevitably be degraded to some extent. If the belt has not made one rotation when printing is finished (step S104-N), the entire control section 601 increments the unfinished rotation counter by one (+1) (step S108). If the incremented count value exceeds a predetermined value (appropriate value is experimentally measured and determined in advance) (step S109-Y), the entire control section 601 awaits until the belt has made one rotation. After having made one rotation of the belt and provided data on the thickness deviation obtained from one rotation of the belt (steps S110, S105), the entire control section 601 stores the obtained data in the non-volatile memory 611, and stops the motor M (step S107).

If, in contrast, the incremented count value is below the predetermined value at step S509 (step S109-N), the entire control section 601 interrupts sampling of data (step S111), stops the motor M (step S107), and stops processing of the image formation module. In this case, the data previously obtained from one rotation of the belt is used as correction data.

In step S109, provided that the number of times the entire control section 601 fails to obtain the data on the thickness deviation from one rotation of the belt exceeds the predetermined number of times, the belt will be driven for one rotation to obtain data on the thickness deviation (step S110, S105). Thus, the accuracy of the data and the life span of the image forming apparatus including the intermediate transfer belt 10 can both be improved.

Note that as shown in the flowchart of FIG. 9, when the number of times the entire control section 601 fails to obtain the data from one rotation of the belt that is counted by the counter exceeds a predetermined number of times, the data obtained from one rotation of the belt are sampled, and the driving roller 15 is corrected based on the sampled data because the accuracy of the data is called into question. In addition, data sampling is also conducted when carrying out first data sampling when the copying apparatus 100 is turned on, when reverting from power saving mode (energy saving mode), and when recovering from a malfunction such as jamming, power cut-off, and the like. Thereafter, normal operation is conducted according to steps in the flowchart shown in FIG. 9.

The unfinished rotation counter operated in step S108 is provided in the CPU 601. FIG. 9 illustrates a case where data sampling is conducted. However, whether or not to conduct the data sampling may be selected via an unshown control panel of the copying apparatus.

Note that in the present embodiment, the driving control of the intermediate transfer belt in the tandem type image forming apparatus is specifically described. However, the application of the present embodiment is not limited thereto, and the present embodiment may be applied to other tandem type image forming apparatuses in which images are directly transferred on a recording sheet (i.e., sheet type recording medium) that is conveyed by a conveyer belt, or to an image forming apparatuses having a photoconductor belt.

According to the embodiment of the invention, the following effects may be obtained:

1) The driving of the supporting roller can be controlled based on the latest sampled data on the thickness deviation, which is achieved by sampling the thickness data from one rotation of the belt as necessary.

2) The life spans of loads can be increased because unnecessary driving of the belt is prevented (the thickness deviation is sampled only when required).

3) The driving of the supporting roller can be corrected based on relatively recent data because data on the thickness deviation are provided whenever the belt has made one rotation.

4) Even failure to obtain the thickness deviation data based on which the drive of the roller is corrected, the roller is still corrected based on the data on the thickness deviation relatively recently obtained from one rotation of the belt. Thus, the belt can still be driven at a constant velocity based on the relatively latest data compared to the case where no correction is made.

5) If no images are formed by the image forming section while detecting the thickness deviation of the belt, the loads uninvolved in sampling of the thickness deviation are switched to stand-by mode. Thus, wear of the loads may be prevented.

6) If printing instructions are input while the loads are in the stand-by mode, some of the loads involved in the printing are immediately turned on. Thus, printing operation can be immediately initiated without causing the user to wait.

7) Sampling data on the thickness deviation of the belt is only conducted upon detecting a predetermined condition. Thus, the thickness deviation of the belt can be corrected without decreasing the life span of the apparatus.

The aforementioned method of detecting the periodical thickness deviation of the endless belt in a circumferential direction, and the method of correcting the detected thickness deviation are only one example of the detection methods and control methods, and other detecting methods and correcting methods may also be applied to the embodiment of the invention.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment of the present invention has been described in detail, it should be understood that the various changes, substitutions, and alterations could be made hereto without departing from the spirit and scope of the invention.

This patent application is based on Japanese Priority Patent Application No. 2008-221621 filed on Aug. 29, 2008, the entire contents of which are hereby incorporated herein by reference.

What is claimed is:

1. A belt driving control device comprising:

an endless belt looped over a plurality of supporting rollers;

a driving source configured to supply rotational driving force to one of the plurality of supporting rollers;

a detecting section configured to detect a periodical thickness deviation of the endless belt in a circumferential direction of the endless belt, and carry out data sampling for detection of the thickness deviation simultaneously with rotation of the endless belt;

a memory configured to store data on the thickness deviation of the endless belt obtained based on the data sampling; and a control section configured to control drive of the driving source such that the detected thickness deviation of the endless belt by the detecting section is canceled out based on the data on the thickness deviation stored in the memory, and such that the endless belt is driven to travel one rotation upon detecting a time when the belt driving control device reverts from power saving mode even if the travel of the endless belt for one rotation is not needed for a printing purpose so as to carry out the data sampling for one rotation and update the data stored in the memory with new data obtained based on the data sampling.

2. The belt driving control device as claimed in claim 1, wherein the detecting section includes: a driven supporting roller detecting section configured to detect one of a rotational angular displacement and a rotational angular velocity of one of the plurality of supporting rollers to function as a driven supporting roller which is uninvolved in transmission of the rotational driving force, a driving supporting roller detecting section configured to detect one of a rotational angular displacement and a rotational angular velocity of one of the plurality of supporting rollers to function as a driving supporting roller to which the rotational driving force is supplied from the driving source, and an extraction section configured to extract amplitudes and phases of an AC component of a rotational angular velocity and a rotational angular displacement of the endless belt having frequencies corresponding to periodical thickness fluctuation of the endless belt in the circumferential direction as a thickness deviation, based on a difference between a detected result obtained by the driven supporting roller and a detected result obtained by the driving supporting roller; and wherein the control section is configured to control rotation of the driving supporting roller based on the amplitudes and phases of the AC component extracted by the extraction section.

3. The belt driving control device as claimed in claim 1, wherein the detecting section includes an instruction section configured to stop the detecting section from detecting operation.

4. A belt device comprising:

the belt driving control device as claimed in claim 1; and the driving source as claimed in claim 1 is controlled by the belt driving control device.

5. An image forming apparatus comprising:

the belt device as claimed in claim 4; and an image forming section configured to form images on an endless belt and transfer the formed images on a recording medium to form visible images.

6. An image forming apparatus comprising:

the belt device as claimed in claim 4; and an image forming section configured to form images on a sheet-type recording medium conveyed by the endless belt.

7. The image forming apparatus as claimed in claim 5, further comprising:

a detecting section; and a plurality of loads, wherein if image forming operation is not operated by the image forming section while the detecting section operates detection of a thickness deviation of the endless belt, at least one of the loads uninvolved in the detection of the thickness deviation of the endless belt remains in stand-by mode.

8. The image forming apparatus as claimed in claim 7, wherein the plurality of loads includes a device for charging, a developing device for developing the images, and a fixation device for fixation of the images.

9. The image forming apparatus as claimed in claim 7, wherein when a subsequent image forming instruction is input to the image forming section while at least one of the loads remains in stand-by mode, the image forming section cancels the stand-by mode and initiates the image forming operation.

10. The image forming apparatus as claimed in claim 7, further comprising:

four photoconductor drums arranged in series, wherein the visible images are formed by transferring images formed on four photoconductor drums onto the recording medium.

11. A method for controlling driving of a belt in a belt driving control device including an endless belt looped over a plurality of supporting rollers, a driving source configured to supply rotational driving force to one of the plurality of supporting rollers, a control section configured to control drive of the driving source, and a detecting section configured to detect a periodical thickness deviation of the endless belt in the circumferential direction of the endless belt, the method comprising:

carrying out first data sampling for the detection of the thickness deviation simultaneously with rotation of the endless belt;

storing data on the thickness deviation of the endless belt obtained based on the first data sampling; and driving the driving source such that the detected thickness deviation is canceled out based on the stored data and such that the endless belt is driven to travel one rotation upon detecting a time when the belt driving control device reverts from power saving mode even if the travel of the endless belt for one rotation is not needed for a printing purpose so as to carry out second data sampling for one rotation and update the stored data with new data obtained based on the second data sampling.

12. The method for controlling driving of a belt as claimed in claim 11, wherein the step of carrying out first data sampling includes a first step of detecting one of a rotational angular displacement and a rotational angular velocity of one of the plurality of supporting rollers uninvolved in transmission of the rotational driving force to function as a driven supporting roller, a second step of detecting one of a rotational angular displacement and a rotational angular velocity of one of the plurality of supporting rollers to function as a driving supporting roller to which the rotational driving force is supplied from the driving source, a third step of extracting amplitudes and phases of an AC component of a rotational angular velocity and a rotational angular displacement of the endless belt having frequencies corresponding to periodical thickness fluctuation of the endless belt in the circumferential direction as a thickness deviation, based on a difference between a detected result obtained in the first step and a detected result obtained in the second step, and a fourth step of controlling rotation of the driving supporting roller based on the amplitudes and phases extracted in the third step.

13. A non-transitory computer-readable storage medium with a computer program for causing a computer to control a belt driving control device including an endless belt looped over a plurality of supporting rollers, a driving source configured to supply rotational driving force to one of the plurality of supporting rollers, a control section configured to control drive of the driving source, and a detecting section configured to detect a periodical thickness deviation of the endless belt in the circumferential direction of the endless belt, the computer program causing the computer to control the belt driving control device to perform the steps comprising:

carrying out first data sampling for the detection of the thickness deviation simultaneously with rotation of the endless belt;

storing data on the thickness deviation of the endless belt obtained based on the first data sampling; and driving the driving source such that the detected thickness deviation is canceled out based on the stored data and such that the endless belt is driven to travel one rotation upon detecting a time when the belt driving control device reverts from power saving even if the travel of the endless belt for one rotation is not needed for a printing purpose so as to carry out second data sampling for one rotation and update the stored data with new data obtained based on the second data sampling.

* * * * *